US006269595B1

(12) United States Patent
Blubaugh et al.

(10) Patent No.: US 6,269,595 B1
(45) Date of Patent: Aug. 7, 2001

(54) GRIDWALL

(76) Inventors: David A. Blubaugh; Elmo A. Blubaugh, both of 8346 Bunnell Hill Rd., Springboro, OH (US) 45066

( * ) Notice: Subject to any disclaimer, the term of this patent is extended or adjusted under 35 U.S.C. 154(b) by 0 days.

(21) Appl. No.: 09/314,933

(22) Filed: May 20, 1999

(51) Int. Cl.[7] ..... E04B 1/00; G01B 3/00

(52) U.S. Cl. ..... 52/105; 52/408; 52/208; 33/1 B; 33/494

(58) Field of Search ..... 52/105, 408, 208; 33/1 B, 494

(56) References Cited

U.S. PATENT DOCUMENTS

| | | | | |
|---|---|---|---|---|
| 3,774,428 | * | 11/1973 | Derry et al. | 72/46 |
| 3,798,854 | | 3/1974 | Hinojosa et al. . | |
| 4,031,681 | * | 6/1977 | Charniga | 52/408 |
| 4,397,123 | | 8/1983 | Parker . | |
| 4,584,223 | * | 4/1986 | Krapf | 428/58 |
| 4,672,787 | * | 6/1987 | Murphy | 52/409 |
| 4,738,067 | * | 4/1988 | Froseth | 52/478 |
| 4,779,346 | * | 10/1988 | Schafer | 33/1 B |
| 4,858,402 | * | 8/1989 | Putz | 52/105 |
| 4,882,888 | * | 11/1989 | Moore | 52/309.9 |
| 4,924,644 | * | 5/1990 | Lewis | 52/105 |
| 4,927,696 | * | 5/1990 | Berg | 428/195 |
| 4,944,124 | | 7/1990 | Armstrong . | |
| 5,027,572 | * | 7/1991 | Purcell et al. | 52/309.9 |
| 5,170,603 | * | 12/1992 | Bartlett | 52/282 |
| 5,601,431 | * | 2/1997 | Howard | 434/79 |
| 5,673,489 | * | 10/1997 | Robell | 33/1 B |
| 5,729,934 | | 3/1998 | Ochoa . | |
| 5,820,958 | * | 10/1998 | Swallow | 428/42.2 |
| 5,826,390 | * | 10/1998 | Sacks | 52/408 |
| 5,884,446 | * | 3/1999 | Hageman | 52/408 |
| 5,924,213 | * | 7/1999 | Lee | 33/494 |
| 5,950,319 | * | 9/1999 | Harris | 33/494 |
| 5,968,630 | * | 10/1999 | Foster | 428/77 |

* cited by examiner

*Primary Examiner*—Daniel P. Stodola
*Assistant Examiner*—Khoa Tran
(74) *Attorney, Agent, or Firm*—Patent & Trademark Services; Joseph H. McGlynn

(57) ABSTRACT

A wallboard or drywall system with two types of measuring indicia on on side of the wallboard or drywall, and an integral, transparent vapor barrier is applied to the back side of the wallboard or drywall. In addition, the system contains adhesive coated plastic tape which can be used to seal adjacent, mating edges of wallboard or drywall panels.

7 Claims, 1 Drawing Sheet

GRIDWALL

BACKGROUND OF THE INVENTION

This invention relates, in general, to a wallboard or drywall system, and, in particular, to a wallboard or drywall system marked with a grid system to facilitate the installation of wallboard or drywall and utilizing two types of vapor barriers

DESCRIPTION OF THE PRIOR ART

In the prior art various types of wallboard or drywall have been proposed. For example, U.S. Pat. No. 3,798,854 to Hinojosa et al discloses prefinished wall board which has a layer of settable material on one side and a decorative pattern formed in relief in the settable material.

U.S. Pat. No. 4,397,123 to Parker discloses drywall board with widthwise extending tear-off strips on the back side of each butt end which allows the butt ends to bend when the strips are removed.

U.S. Pat. No. 4,944,124 to Armstrong discloses a panel used for skirting on a mobile home which has a raised masonry surface.

U.S. Pat. No. 5,729,934 to Ochoa discloses an L-shaped coping for drywall corners marked with indicia to facilitate the installation.

SUMMARY OF THE INVENTION

The present invention is directed to a wallboard or drywall system with two types of measuring indicia on on side of the wallboard or drywall, and an integral, transparent vapor barrier is applied to the back side of the wallboard or drywall. In addition, the system contains adhesive coated plastic tape which can be used to seal adjacent, mating edges of wallboard or drywall panels.

It is an object of the present invention to provide a new and improvedwallboard or drywall system.

It is an object of the present invention to provide a new and improved wallboard or drywall system which has a grid system to facilitate cutting of wallboard or drywall.

It is an object of the present invention to providea new and improved wallboard or drywall system which utilizes two types of vapor barriers to protect the drywall from the damaging effects of moisture.

These and other objects and advantages of the present invention will be fully apparent from the following description, when taken in connection with the annexed drawings.

DESCRIPTION OF THE PREFERRED EMBODIMENT

Figure 1:
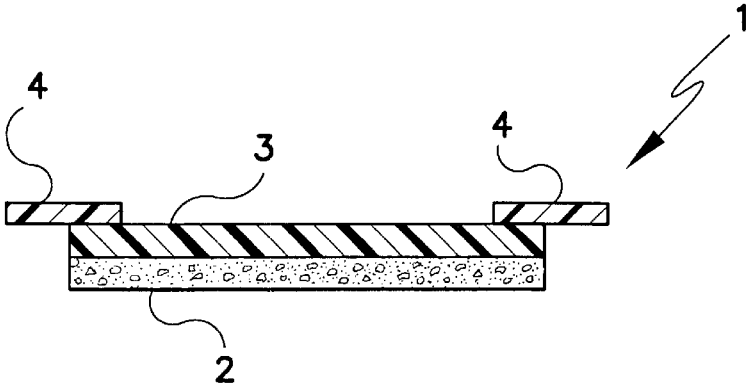
FIG. 1 is a cross-sectional view of the present invention.

Referring now to the drawings in greater detail, FIG. 1 shows a cross-sectional view of the panel system 1 of the present invention. It comprised a convention drywall or wallboard panel 2, which can be in any of the standard sizes which are used in the construction of wallboard panels, and is made of any of the conventional wallboard materials.

Secured to the back side (i.e. the side of the wallboard that will be closely adjacent the studs to which the wallboard is attached) is a laminated, plastic sheet 3 which is made from any conventional material that is resistant to moisture. The thickness of this sheet 3 can be from 1 mil to 15 mils thick with a thickness of 4 mil being preferred, however, other thicknesses can be used without departing from the scope of the present invention. The plastic sheet 3 is laminated onto the back of the wallboard 2 and covers the entire back surface of the wallboard. The plastic sheet 3 will protect the wallboard and any insulation in the wall from water vapor condensing and destroying the insulation. The addition of this sheet to the wallboard makes it more convenient for construction workers since they will not have to hang a separate vapor barrier during the constructions of internal walls.

Figure 2:
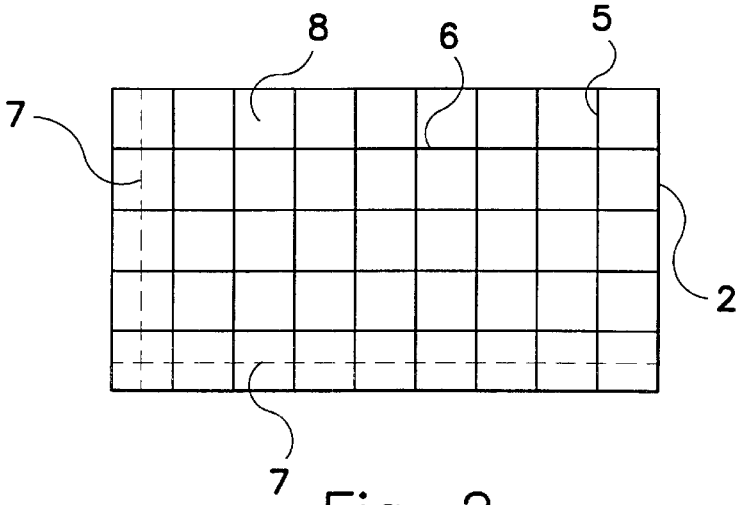
FIG. 2 is a plan view of the drywall panel of the present invention.

As shown in FIG. 2, each wallboard panel 2 has a gridwork consisting of vertical lines 5 and horizontal lines 6. Where the lines 5, 6 cross they form a square 8 (see also FIG. 3). This gridwork pattern can be printed, or applied by any other conventional method, in any color on the back of the panel 2. Each of the squares 8 measure one inch on each side, and the total number of squares can vary from 48 by 96 to 48 by 144 depending on the size of the wallboard. Since the squares are one inch on each side, it will be easy and convenient for workers to cut panels without resorting to marking the panels using conventional measuring instruments (tape measure) and pencil or chalk lines. This will minimize the amount of time required to install drywall. It should be noted that the markings are shown as being placed on the panel 2, however, the markings could instead be placed on the sheet 3. If the markings are placed on the panel 2, the sheet 3 should be transparent so the markings will show through the sheet 3.

The dotted lines 7, in FIG. 2 are marks that represent ½ inch marking cuts. As shown, the dotted lines 7 are only placed on the left-most and bottom square on the panel 3, however, it should be noted that this is merely for illustrational purposes, and the lines 7 could be placed in all the squares 8.

Figure 3:
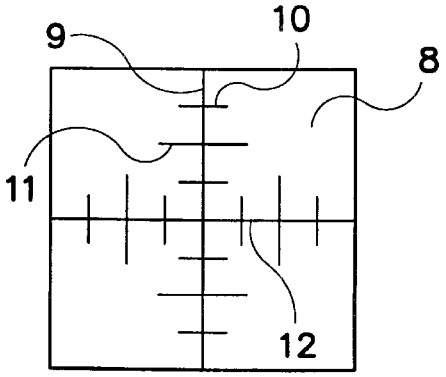
FIG. 3 is a plan view of the one of the grid squares used with the grid system of the present invention.

As shown in FIG. 3, each of the squares 8 is further marked with dimension lines 11, 10 along the vertical line 9 and the horizontal line 12. The mark 10 represents ⅛ inch and the mark 11 represents ¼ inch. Therefore, these additional dimension markings will make it convenient for workers to make accurate cuts which fall in between the 1 inch markings.

Figure 4:
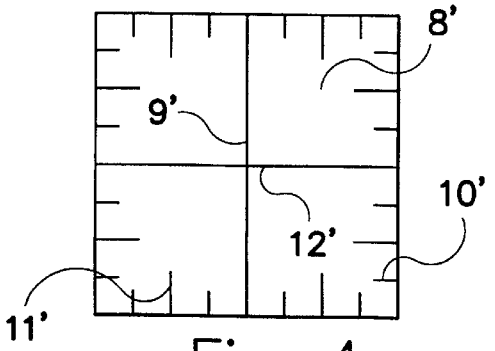
FIG. 4 is a plan view of another embodiment of the grid squares used with the grid system of the present invention.

The FIG. 4 embodiment is similar to the FIG. 3 embodiment except the markings 10', 11' are placed along the edges of the square 8' and not along the lines 9, 12. In all other respects, the markings 10', 11' function in the same manner as the markings 10, 11. Also, it should be noted that the markings 5, 6, 7, 9, 10, 11 and 12 could be produced in different colors to make it easy for workers to differentiate the different markings when making cuts in the wallboard.

As shown in FIG. 1, each panel 2 and sheet 3 will have adhesive coated plastic strips 4 attached to the back sides of the panel. The strips 4 can be any width from 3 to 6 inches and any length. These strips will be placed along at least the edges of the panel 2 that will be adjacent another panel 2. These strips will act as vapor barriers for the joint between adjacent panels 2. In addition, the strips could be placed along the top and bottom of the panels if necessary. The strips could be produce in lengths to match the lengths and widths of the panels 2 or they could be produced on rolls and cut to size on the job as the panels are being installed.

Although the Gridwall and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A wallboard comprising:

a panel having a length, width, thickness, and having a front surface and a rear surface, a plastic sheet secured to said rear surface of said panel, one of said panel and said plastic sheet having indicia placed thereon, said indicia being vertical and horizontal lines, forming squares, adjacent horizontal and vertical lines being formed at a specified distance from each other, and said panel has at least one second plastic sheet attached to said rear surface via said plastic sheet along at least one side of said panel, only a portion of said second plastic sheet being secured to said panel, and a second portion of said second plastic sheet extending beyond said sides of said panel and wherein the second plastic strip act as a vapor barrier for joints formed between adjacent panels.

2. The system for installing drywall as claimed in claim 1, wherein said panel is drywall.

3. The system for installing drywall as claimed in claim 1, wherein said indicia is on said panel and said plastic sheet is transparent.

4. The system for installing drywall as claimed in claim 1, wherein horizontal and vertical lines are formed at a specified distance of one inch from each other.

5. The system for installing drywall as claimed in claim 1, wherein additional horizontal and vertical lines are formed at a specified distance from each other, said additional horizontal and vertical lines are spaced at a distance of one half inch from said horizontal and vertical lines.

6. The system for installing drywall as claimed in claim 1, wherein each of said squares have a plurality of additional indicia placed thereon, said additional indicia being placed along vertical and horizontal lines within each square, each of said additional indicia being placed a specific distance from each other.

7. The system for installing drywall as claimed in claim 1, wherein said indicia are different colors.

* * * * *